US005464004A

United States Patent [19]

Maughan

[11] Patent Number: 5,464,004

[45] Date of Patent: Nov. 7, 1995

[54] ATMOSPHERIC GAS BURNER HAVING DIFFUSION PILOT FOR IMPROVED DYNAMIC STABILITY

[75] Inventor: James R. Maughan, Scotia, N.Y.

[73] Assignee: General Electric Company, Schenectady, N.Y.

[21] Appl. No.: 217,833

[22] Filed: Mar. 25, 1994

[51] Int. Cl.[6] ..... F24C 3/00

[52] U.S. Cl. ..... 126/39 E; 126/39 H; 431/278; 431/2

[58] Field of Search ..... 431/278, 350, 431/2, 281, 285; 126/39 E, 39 H

[56] References Cited

U.S. PATENT DOCUMENTS

| | | | |
|---|---|---|---|
| 2,843,199 | 7/1958 | Brodbeck et al. | 431/278 X |
| 4,757,801 | 7/1988 | Le Monnier de Gouville et al. | 126/39 H |
| 4,891,006 | 1/1990 | Le Monnier de Gouville et al. | 126/39 H |
| 4,968,246 | 11/1990 | Sasada et al. | 126/39 E X |
| 5,133,658 | 7/1992 | Le Monnier De Gouville et al. | 431/349 |
| 5,213,091 | 5/1993 | Beach | 126/39 H X |
| 5,246,365 | 9/1993 | Himmel et al. | 126/39 H |

FOREIGN PATENT DOCUMENTS

| | | | |
|---|---|---|---|
| 33528 | 3/1980 | Japan | 126/39 E |

*Primary Examiner*—Larry Jones
*Attorney, Agent, or Firm*—Paul R. Webb, II

[57] ABSTRACT

An atmospheric gas burner produces improved flame stability by establishing a higher pressure drop pilot flame at at least one burner port. The burner has a preferably recessed pilot port which is isolated from the primary burner ports. A small portion of the total fuel introduced to the burner is directly fed to the pilot port without entrained air. Consequently, the pilot port supports a high pressure drop diffusion pilot flame which is better able to withstand ambient disturbances. Then in the event that a momentary disturbance extinguishes the primary flames, the pilot flame will serve as a reignition source.

18 Claims, 1 Drawing Sheet

ATMOSPHERIC GAS BURNER HAVING DIFFUSION PILOT FOR IMPROVED DYNAMIC STABILITY

BACKGROUND OF THE INVENTION

This invention relates generally to atmospheric gas burners, particularly to gas burners for domestic cooking appliances. The invention more specifically relates to improvements in gas burners for reducing flame instability.

Atmospheric gas burners are commonly used as surface units in household gas cooking appliances. A significant factor in the performance of such gas burners is their ability to withstand disturbances in the surroundings, such as room drafts or oven door slams. Manipulation of the oven door can be particularly troublesome because opening and closing of the oven door produces a momentary under-pressure and over-pressure, respectively, in the oven cavity. This causes a temporary condition in which a flow of air is required to reequilibrate the oven pressure. Since the flue through which combustion products are removed from the oven is sized to maintain the desired oven temperature and is thus generally inadequate to supply a sufficient air flow for reequilibration, a large amount of air passes through or around the burners.

This surge of air is detrimental to the flame stability of the burners and can even cause extinction of the flames. Unwanted flame extinction not only presents an obvious quality concern but also creates a potential safety hazard in that unburned gas will be emitted from the burner after the disturbance passes. The problem is particularly evident in the so-called sealed gas burner arrangements (referring to the lack of an opening in the cooktop surface around the base of the burner to prevent spills from entering the area beneath the cooktop), and while the burners are operating near their minimum input rate.

The inherent cause of this flame instability is the low pressure drop of the gas/air mixture passing through the burner ports of a typical rangetop burner. Although there is ample pressure available in the fuel, the pressure energy is used to accelerate the fuel to the high injection velocity required for primary air entrainment. Relatively little of this pressure is recovered at the burner ports. A low pressure drop across the ports allows pressure disturbances propagating through the ambient to easily pass through the ports, momentarily drawing the flame towards the burner head and leading to thermal quenching and extinction.

Accordingly, there is a need for an atmospheric gas burner which is better able to withstand ambient pressure disturbances.

SUMMARY OF THE INVENTION

The above-mentioned needs are met by the present invention which provides a gas burner comprising a substantially cylindrical burner body having a sidewall, a gas feed conduit, a main fuel chamber, and a plurality of primary burner ports. A main inlet passage extends axially through the center of the burner body and is aligned with an injection orifice formed in the gas feed conduit. The main inlet passage is open to the exterior of the burner body to permit the ingress of air to support combustion. The gas/air mixture in the main fuel chamber is discharged through the primary burner ports for combustion.

A pilot port is formed in the sidewall, isolated from the main fuel chamber. A pilot inlet passage connects the gas feed conduit to the pilot port. The pilot port is preferably located in a recess formed in the sidewall. Approximately 4–6% of the total fuel introduced to the gas feed conduit is delivered to the pilot port. Because gas is fed directly to the pilot port with no entrained air, the pilot port will support a diffusion pilot flame independently of the primary burner ports. Moreover, the pressure drop across the pilot port is much greater than the pressure drop across the primary burner ports. Accordingly, the diffusion pilot flame is more stable than the primary flames.

Alternatively, the pilot inlet passage is connected to a source of gas independently of the gas feed conduit. In which case, a dual valve can be used wherein the flow rate of fuel through the main inlet passage is variable, and the the flow rate of fuel through the pilot inlet passage is constant.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
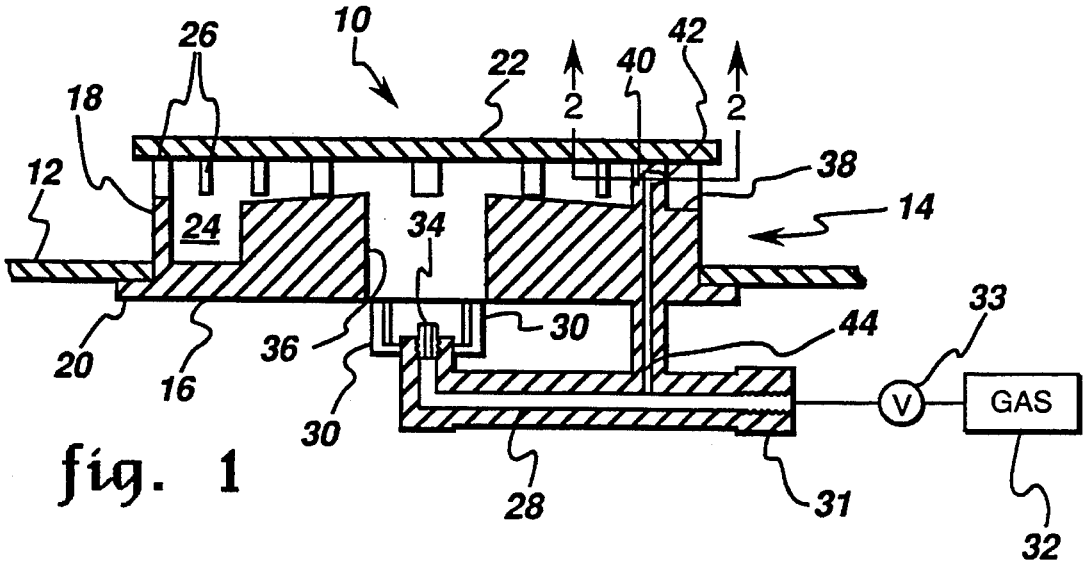
FIG. 1 is a cross-sectional plan view of a first embodiment of a gas burner in accordance with the present invention.
Figure 2:
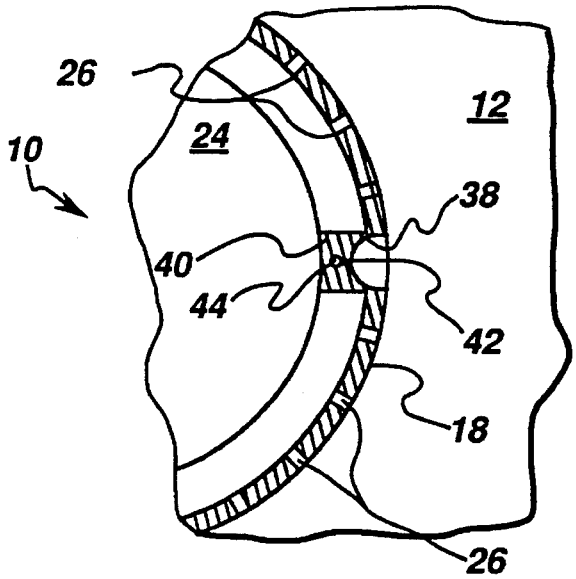
FIG. 2 is a fragmentary, cross-sectional top view of the gas burner taken along line 2—2 of FIG. 1.

Referring to the drawings wherein identical reference numerals denote the same elements throughout the various views, FIGS. 1 and 2 show an atmospheric gas burner 10 of the present invention. The gas burner 10 is attached to a support surface 12 which forms a portion of the top side of a gas cooking appliance such as a range or cooktop. As shown in FIG. 1, the gas burner 10 is arranged as a so-called sealed burner. This refers to there being no opening between the support surface 12 and the base of the burner 10. The area beneath the support surface is thus sealed off to prevent spills from entering, thereby facilitating cleaning of the cooking surface. However, it should be understood that the gas burner 10 of the present invention is not limited to use in sealed burner appliances, but is equally applicable to other types of gas cooking appliances.

The gas burner 10 comprises a substantially cylindrical burner body 14 having a solid base portion 16 and cylindrical sidewall 18 extending axially from the periphery of the base portion 16. An annular flange 20 extends radially from the bottom of the base portion 16 and provides a means for attaching the burner 10 to the support surface 12. A cap 22 covers the top of the burner body 14, thereby defining a main fuel chamber 24 within the burner body 14. The cap 22 can either be fixedly attached to the sidewall 18 or simply rest on the sidewall 18 for easy removal. While one type of burner is described and illustrated, the present invention is applicable to other types of burners, such as stamped aluminum burners and separately mounted orifice burners, among others.

A plurality of primary burner ports 26 are formed in the sidewall 18 so as to be in fluid communication with the main fuel chamber 24. The primary burner ports 26 are distributed around the circumference of the sidewall 18 and are typically, although not necessarily, evenly spaced. As used herein, the term "port" refers to an aperture of any shape from which a flame can be supported.

A gas feed conduit 28 is attached to the underside of the burner body 14 by a number of support brackets 30 (two shown in FIG. 1). A coupling 31 is formed on one end of the gas feed conduit 28 for connection to a source of gas 32 via a valve 33 (shown schematically). The valve 33 is controlled in a known manner by a corresponding control knob on the gas cooking appliance to regulate the flow of gas from the source 32 to the gas feed conduit 28. The other end of the gas feed conduit 28 is provided with an injection orifice 34. The injection orifice 34 is aligned with a main inlet passage 36 formed in the burner body 14. The main inlet passage 36 is open to the exterior of the burner body 14 and extends axially through the center of the burner body 14 to provide fluid communication with the main fuel chamber 24. Thus, gas discharged from the injection orifice 34 and entrained air are supplied to the main fuel chamber 24 via the main inlet passage 36. Primary air to support combustion is obtained from the ambient space around the burner 10 and is entrained in conventional fashion through the open spaces between the support brackets 30. The gas/air mixture in the main fuel chamber 24 is discharged through the primary burner ports 26 for combustion.

At least one recess 38 is formed in the upper portion of the sidewall 18. As best seen in FIG. 2, the recess 38 preferably, but not necessarily, has a semi-circular shape. An embossment 40 is formed behind the recess 38 on the solid base portion 16 of the burner body 14 and extends into the main fuel chamber 24. A pilot port 42 is formed in the recess 38. The pilot port 42 is isolated from the main fuel chamber 24 in the sense that it is not in fluid communication with the main fuel chamber 24 and is thus independent of the primary burner ports 26. Gas from the gas feed conduit 28 is directly fed to the pilot port 42 by a pilot inlet passage 44 which extends from the gas feed conduit 28 through the base portion 16 and the embossment 40 and terminates at the pilot port 42. While a single pilot port 42 is generally sufficient to adequately improve the dynamic stability of the gas burner 10, the present invention also encompasses the possibility of using of one or more additional pilot port arrangements which are identical or substantially similar to the pilot port arrangement described above.

Because of the direct gas feed, the pilot port 42 will support a diffusion pilot flame independently of the primary burner ports 26 which are fed the gas/air mixture from the main fuel chamber 24. Since no air is entrained, gas is fed to the pilot port 42 at full pressure resulting in a higher pressure drop across the pilot port 42 than is realized across the primary burner ports 26. Accordingly, the diffusion pilot flame is significantly more stable than the flames of the primary burner ports 26. It should be noted that the diffusion pilot flame of the pilot port 42 is not a "pilot flame" in the sense that it burns constantly, even when the burner is not in operation, to serve as an ignition source when the burner is turned on. Instead, this diffusion pilot flame only burns while the burner is in operation and serves as a reignition source in the event the primary flames are unintentionally extinguished.

As an alternative, the recess 38 could be eliminated, and the pilot port 42 would then be formed directly in the sidewall 18. There would still be a high pressure drop across the pilot port 42 even without the recess 38, assuring a stable diffusion pilot flame. However, the recess 38 forms a stability chamber which provides a degree of protection to the pilot flame from certain disturbances such as room drafts, thereby further enhancing the stability of the pilot flame.

The pilot inlet passage 44 does not necessarily need to be an integral part of the burner body 14, as described above. Alternatively, a length of flexible tubing can be connected between the gas feed conduit 28 and the pilot port 42. In any event, the pilot inlet passage 44 is sized so that a suitable portion of the fuel entering the gas feed conduit 28 is delivered to the pilot port 42 while the remainder of the fuel is supplied to main fuel chamber 24 via the injection orifice 34. The portion of fuel fed to the pilot port 42 is ideally equal or close to the amount of fuel that would have been discharged through the primary burner port or ports which would have been formed in the sidewall 18 if not for the inclusion of the recess 38 and the pilot port 42. This will typically be approximately 4–6% of the total fuel delivered through the gas feed conduit.

In operation, the control knob on the gas cooking appliance which corresponds to the desired gas burner 10 is operated, thereby opening valve 33 to provide fuel to the gas feed conduit 28. From the gas feed conduit 28, gas flows through the orifice 34 and entrains air for combustion. The gas/air mixture flows into the main fuel chamber 24 through the main inlet passage 36 and is discharged through the primary burner ports 26 for combustion. The mixture is initially ignited by a spark ignition electrode (not shown).

At the same time, a small portion of the fuel from the gas feed conduit 28 is directly fed to the pilot port 42 via the pilot inlet passage 44. This fuel is discharged from the pilot port 42 and produces a diffusion pilot flame. Since the fuel is injected with the full gas pressure, an acoustically closed boundary condition is created, and the diffusion pilot flame, unlike the flames from the primary burner ports 26, cannot be easily drawn toward or forced through the pilot port 42. The potential of thermal quenching is thus greatly reduced and flame stability for the pilot port 42 is enhanced. Moreover, disturbances under the support surface 12 cannot propagate to the recess 38. Thus, the diffusion pilot flame will be able to withstand transient disturbances which extinguish the flames from the primary burner ports 26 and will subsequently serve as a reignition source for the primary burner ports 26 after the disturbance has passed.

Figure 3:
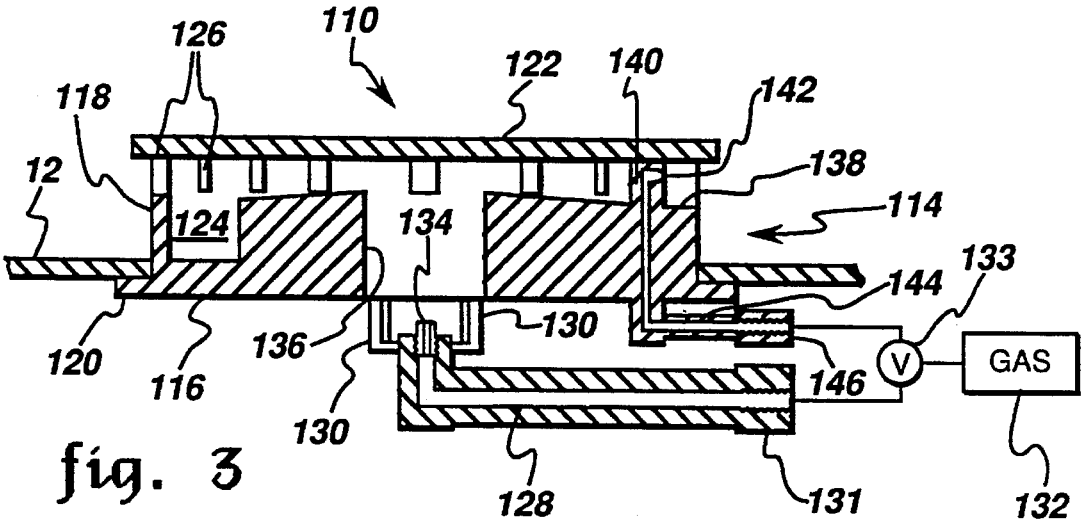
FIG. 3 is a cross-sectional plan view of a second embodiment of a gas burner in accordance with the present invention.

FIG. 3 shows an atmospheric gas burner 110 which is another embodiment of the present invention. The gas burner 110 is attached to a support surface 12 of a gas cooking appliance. Like the gas burner of the first embodiment, the gas burner 110 comprises a substantially cylindrical burner body 114 having a solid base portion 116 and a cylindrical sidewall 118, an annular flange 120, a cap 122, and a main fuel chamber 124. A plurality of primary burner ports 126 are formed in the sidewall 118, and a main inlet passage 136 is formed in the base portion 116. A gas feed conduit 128 having an injection orifice 134 is attached to the underside of the burner body 114 by a number of support brackets 130 (two shown in FIG. 3). The injection orifice 134 is aligned with the main inlet passage 136 which provides fluid communication with the main fuel chamber 124. A coupling 131 is formed on the outer end of the gas feed conduit 128 for connection to a source of gas 132 via a dual valve 133 (shown schematically). The dual valve 133 is controlled in a known manner by a corresponding control knob on the gas cooking appliance to regulate the flow of gas from the source 132 to the gas feed conduit 128.

A recess 138 is formed in the upper portion of the sidewall

118. Behind the recess 138, an embossment is 140 formed on the solid base portion 116 of the burner body 114 and extends into the main fuel chamber 124. A pilot port 142 is formed in the recess 138 so as to be isolated from the main fuel chamber 124. Gas is fed directly to the pilot port 142 by a pilot inlet passage 144. The pilot inlet passage 144 extends through the base portion 116 and the embossment 140 and terminates at the pilot port 142. The pilot inlet passage 144 differs from that of the prior embodiment of FIG. 1 in that it does not connect with the gas feed conduit 128. Instead, the pilot inlet passage 144 extends outwardly from the burner body 114 substantially parallel to the gas feed conduit 128. A coupling 146 is formed on the outer end of the pilot inlet passage 144 for connection to the source of gas 132 via the dual valve 133.

The dual valve 133 is of a type well known in the art and is capable of providing a constant flow of fuel to one output and a variable flow of fuel to its other output. Thus, whenever the dual valve 133 is opened by the corresponding control knob on the gas cooking appliance to operate the burner 110, a constant flow of fuel is fed to the pilot inlet passage 144. On the other hand, the fuel flow to the gas feed conduit 128 can be varied by adjusting the appropriate control knob. The constant amount of fuel delivered to the pilot inlet passage 144 is much smaller than even the minimum amount of fuel supplied to the gas feed conduit 128.

The foregoing has described an atmospheric gas burner in which flame stability is improved by establishing a higher pressure drop pilot flame at at least one burner port. While specific embodiments of the present invention have been described, it will be apparent to those skilled in the art that various modifications thereto can be made without departing from the spirit and scope of the invention as defined in the appended claims.

What is claimed is:

1. A gas burner assembly for connection to a source of gas, said gas burner assembly comprising:

a burner body having a plurality of primary burner ports formed therein;

first means joinable to said gas source for channeling primary gas to said primary burner ports;

a pilot port formed in said burner body adjacent to said primary ports for providing a reignition source therefor; and second means joinable to said gas source for directly channeling secondary gas to said pilot port independently of said primary gas being channeled to said primary ports.

2. The gas burner assembly of claim 1 further comprising a recess formed in said burner body, said pilot port being located in said recess.

3. The gas burner assembly of claim 1 wherein said second means includes a passage sized so that approximately 4–6% of the total fuel introduced to said gas burner assembly is delivered to said pilot port.

4. A gas burner assembly comprising:

a burner body including a sidewall;

at least one primary burner port formed in said sidewall;

a first passage in fluid communication with said primary burner port;

a pilot port formed in said sidewall adjacent to said primary ports for providing a reignition source therefor; and a second passage in fluid communication with said pilot port for directly channeling gas thereto independently of gas channeled to said primary port from said first passage.

5. The gas burner assembly of claim 4 further comprising a plurality of additional primary burner ports formed in said sidewall, each one of said additional primary burner ports being in fluid communication with said first passage.

6. The gas burner assembly of claim 4 further comprising a recess formed in said sidewall, said pilot port being located in said recess.

7. The gas burner assembly of claim 4 wherein said second passage is sized so that approximately 4–6% of the total fuel introduced to said gas burner assembly is delivered to said pilot port.

8. The gas burner assembly of claim 4 further comprising a valve joined to said first and second passages and being effective so that said first passage receives a variable rate flow of fuel through said valve and said second passage receives a constant rate flow of fuel through said valve.

9. A gas burner assembly comprising:

a burner body including a sidewall and a gas feed conduit;

a main fuel chamber formed within said burner body;

a plurality of primary burner ports formed in said sidewall, said primary burner ports being in fluid communication with said main fuel chamber;

a main inlet passage formed in said burner body, said main inlet passage providing fluid communication between said gas feed conduit and said main fuel chamber;

a pilot port formed in said sidewall adjacent to said primary ports for providing a reignition source therefor; and a pilot inlet passage connecting said gas feed conduit to said pilot port for directly feeding gas to said pilot port independent of gas fed to said primary ports.

10. The gas burner assembly of claim 9 wherein said pilot port is isolated from said main fuel chamber.

11. The gas burner assembly of claim 9 further comprising a recess formed in said sidewall, said pilot port being located in said recess.

12. The gas burner assembly of claim 11 wherein said recess is semi-circular.

13. The gas burner assembly of claim 9 wherein said pilot inlet passage is sized so that approximately 4–6% of the total fuel introduced to said gas feed conduit is delivered to said pilot port.

14. The gas burner assembly of claim 9 wherein said burner body is substantially cylindrical.

15. The gas burner assembly of claim 9 wherein said gas feed conduit includes an injection orifice which is aligned with said main inlet passage.

16. The gas burner assembly of claim 15 wherein said main inlet passage extends axially through the center of said burner body.

17. The gas burner assembly of claim 16 wherein said main inlet passage is open to the exterior of said burner body at said injection orifice to permit ingress of air to support combustion.

18. A method of reducing flame instability in a gas burner assembly having a plurality of burner ports and a pilot port, said method comprising:

independently channeling gas to said pilot port and to said plurality of burner ports; and producing a pressure drop across said pilot port which is higher than the pressure drop across said burner ports.

* * * * *